US010330332B2

(12) United States Patent
Seo

(10) Patent No.: US 10,330,332 B2
(45) Date of Patent: Jun. 25, 2019

(54) FLOATING-TYPE HUMIDIFIER

(71) Applicant: MIRO CO. LTD., Incheon (KR)

(72) Inventor: Dong Jin Seo, Incheon (KR)

(73) Assignee: MIRO CO. LTD., Incheon (KR)

( * ) Notice: Subject to any disclaimer, the term of this patent is extended or adjusted under 35 U.S.C. 154(b) by 99 days.

(21) Appl. No.: 15/534,884

(22) PCT Filed: Jan. 28, 2015

(86) PCT No.: PCT/KR2015/000918
§ 371 (c)(1),
(2) Date: Jun. 9, 2017

(87) PCT Pub. No.: WO2016/117743
PCT Pub. Date: Jul. 28, 2016

(65) Prior Publication Data

US 2018/0135875 A1 May 17, 2018

(30) Foreign Application Priority Data

Jan. 21, 2015 (KR) ..... 10-2015-0009904

(51) Int. Cl.
*B01F 3/04* (2006.01)
*F24F 6/12* (2006.01)
(Continued)

(52) U.S. Cl.
CPC ..... *F24F 6/12* (2013.01); *B01F 3/0407* (2013.01); *B01F 11/0258* (2013.01); *F24F 6/06* (2013.01);
(Continued)

(58) Field of Classification Search
CPC ..... B01F 3/0407; B01F 11/0258; B01F 2215/0091; F24F 6/06; F24F 6/12; F24F 13/08; F24F 2006/008; F24F 2013/205; Y02B 30/80
USPC ..... 261/30, 81, 120
See application file for complete search history.

(56) References Cited

U.S. PATENT DOCUMENTS 4,410,139 A * 10/1983 Nishikawa ..... B05B 17/0615 239/102.2
5,485,828 A * 1/1996 Hauser ..... B05B 17/06 128/200.16
(Continued)

FOREIGN PATENT DOCUMENTS

JP 2002-052355 A 2/2002
KR 10-0990236 B1 10/2010
(Continued)

*Primary Examiner* — Charles S Bushey
(74) *Attorney, Agent, or Firm* — Novick, Kim & Lee, PLLC; Sang Ho Lee

(57) ABSTRACT

A floating-type humidifier according to an exemplary embodiment of the present invention includes: a floating body which floats in a reservoir that accommodates water; an ultrasonic wave generation unit which is installed by being inserted into the floating body, and atomizes the water, which is introduced into a lower side of the floating body, into a water particles state by means of ultrasonic vibration; a guide tube which is detachably coupled to the floating body, is installed above the ultrasonic wave generation unit, guides the water particles, and has a fan installation hole horizontally and penetratively formed in a lateral portion of the guide tube; a blower fan which is coupled in the fan installation hole, and injects air into the guide tube so as to discharge the water particles to an upper side of the guide tube; and a discharge groove which is formed in an upper surface of the floating body so as to communicate with the fan installation hole in which the blower fan is mounted.

10 Claims, 5 Drawing Sheets

(51) Int. Cl.

| | |
|---|---|
| ***F24F 13/08*** | (2006.01) |
| ***B01F 11/02*** | (2006.01) |
| ***F24F 6/06*** | (2006.01) |
| *F24F 6/00* | (2006.01) |
| *F24F 13/20* | (2006.01) |

(52) U.S. Cl.
CPC ..... *F24F 13/08* (2013.01); *B01F 2215/0091* (2013.01); *F24F 2006/008* (2013.01); *F24F 2013/205* (2013.01)

(56) References Cited

U.S. PATENT DOCUMENTS

| | | | | |
|---|---|---|---|---|
| 6,592,107 | B1 * | 7/2003 | Wong | F24F 6/02 261/107 |
| 6,726,186 | B2 * | 4/2004 | Gaaloul | B05B 17/0615 239/102.2 |
| 6,854,718 | B1 * | 2/2005 | Liu | B01B 1/005 261/81 |
| 7,490,815 | B2 * | 2/2009 | Tollens | B05B 17/0646 261/30 |
| 9,377,208 | B2 * | 6/2016 | Seo | B05B 17/0623 |
| 10,060,640 | B2 * | 8/2018 | Kim | F24F 6/00 |
| 10,066,846 | B2 * | 9/2018 | Kim | F24F 6/00 |
| 2002/0163090 | A1 * | 11/2002 | Chu | F24F 6/02 261/81 |

FOREIGN PATENT DOCUMENTS

| | | | |
|---|---|---|---|
| KR | 10-2011-0021547 | A | 3/2011 |
| KR | 10-1175928 | B1 | 8/2012 |
| KR | 10-1374967 | B1 | 3/2014 |

* cited by examiner

FLOATING-TYPE HUMIDIFIER

TECHNICAL FIELD

The present invention relates to a floating-type humidifier, and more particularly, to a floating-type humidifier having a structure capable of easily discharging water, which is introduced into a floating body, to the outside.

BACKGROUND ART

In general, a humidifier is a device for providing moisture into a dry room, and the humidifier is classified into an ultrasonic humidifier using ultrasonic waves and a heating humidifier using a heater based on a method of increasing humidity.

First, the ultrasonic humidifier converts water into fine water droplets by using an ultrasonic vibrator installed in a reservoir, and sprays the fine water droplets in an atomized state by using a blower fan, but in contrast, the heating humidifier evaporates water by using heat of a heater installed in a reservoir, and sprays the vapor in an atomized state by using a blower fan.

The two types of humidifiers are used in a state of being installed on a stationary installation surface, and problems about a bacterial growth and cleaning are considered as great drawbacks, and to solve the drawbacks, a natural humidifier, which is comparatively convenient to manage and clean, is widely used.

Among the natural humidifiers, a floating-type humidifier, which is comparatively convenient to manage and clean, is widely used, and the floating-type humidifier is characterized by being installed to be movable in a state in which the floating-type humidifier floats on the water accommodated in a reservoir.

The floating-type humidifier in the related art converts water, which flows into the floating-type humidifier, into fine water particles by using an ultrasonic vibrator while floating in the reservoir at a predetermined height, and discharges the water particles in an atomized state by using a blower fan.

However, the floating-type humidifier in the related art has a structure that is insufficient to discharge introduced water to the outside of the humidifier in a case in which water stored in the reservoir is introduced into the humidifier. Therefore, the floating-type humidifier in the related art has a problem in that the humidifier is sunk into the water by a load of the water introduced into the humidifier.

As literature in the related art associated with the present invention, there is Korean Patent No. 10-1374967 (Mar. 10, 2014) that discloses a floating-type humidifier.

DISCLOSURE

Technical Problem

An object of the present invention is to provide a floating-type humidifier capable of easily discharging water, which is introduced into an upper surface of a floating body, to the outside of the floating body, and solving a problem with an imbalanced posture of the humidifier which is caused when a height of a water surface of the water stored in a reservoir is decreased.

Technical Solution

A floating-type humidifier according to an exemplary embodiment of the present invention includes: a floating body which floats in a reservoir that accommodates water; an ultrasonic wave generation unit which is installed by being inserted into the floating body, and atomizes the water, which is introduced into a lower side of the floating body, into a water particles state by means of ultrasonic vibration; a guide tube which is detachably coupled to the floating body, is installed above the ultrasonic wave generation unit, guides the water particles, and has a fan installation hole horizontally and penetratively formed in a lateral portion of the guide tube; a blower fan which is coupled in the fan installation hole, and injects air into the guide tube so as to discharge the water particles to an upper side of the guide tube; and a discharge groove which is formed in an upper surface of the floating body so as to communicate with the fan installation hole in which the blower fan is mounted.

The upper surface of the floating body may be formed to be inclined downward from an edge to a central portion, and the discharge groove may be formed to be inclined downward toward the central portion along the upper surface of the floating body so as to discharge water which reversely flows into the upper surface of the floating body.

A plurality of protrusions may be formed on a bottom surface of the floating body at a predetermined interval.

A plurality of water inlet holes, which is provided at a predetermined interval between the plurality of protrusions, may be formed in the bottom surface of the floating body.

The guide tube may guide the water particles such that the water particles flow upward along an inner guide hole that defines a circle in a horizontal direction, and the blower fan may inject air toward an inner circumferential surface of the guide hole so as to allow the water particles to be discharged upward by a rotational vortex flow of the air.

The blower fan may be disposed such that a center thereof crosses a vertical central axis of the guide hole, and may obliquely inject air toward a wall surface at one side of the guide hole.

The blower fan may inject air obliquely upward toward the wall surface of the guide hole.

A guide groove or a guide protrusion, which is spirally formed in an up and down direction, may be formed on the inner circumferential surface of the guide hole.

A diameter of the guide hole may be gradually decreased upward.

The ultrasonic wave generation unit may discharge water particles in a direction that crosses a direction in which the blower fan discharges air.

Advantageous Effects

According to the exemplary embodiment of the present invention, it is possible to easily discharge water, which is introduced into the upper surface of the floating body, to the outside of the floating body, and thus to prevent the floating body from being sunk into the water in the reservoir.

According to the exemplary embodiment of the present invention, it is possible to continuously maintain a humidification effect by solving a problem with an imbalanced posture of the humidifier, which is caused when a height of a water surface of the water stored in the reservoir is decreased, by using the plurality of protrusions.

BEST MODE

Hereinafter, exemplary embodiments of the present invention will be described in detail with reference to the accompanying drawings.

Advantages and features of the present invention and methods of achieving the advantages and features will be clear with reference to exemplary embodiments described in detail below together with the accompanying drawings.

However, the present invention is not limited to exemplary embodiment disclosed herein but will be implemented in various forms. The exemplary embodiments are provided so that the present invention is completely disclosed, and a person of ordinary skilled in the art can fully understand the scope of the present invention. Therefore, the present invention will be defined only by the scope of the appended claims.

In addition, in the description of the present invention, a detailed explanation of publicly known related technologies may be omitted so as to avoid unnecessarily obscuring the subject matter of the present invention.

Figure 1:
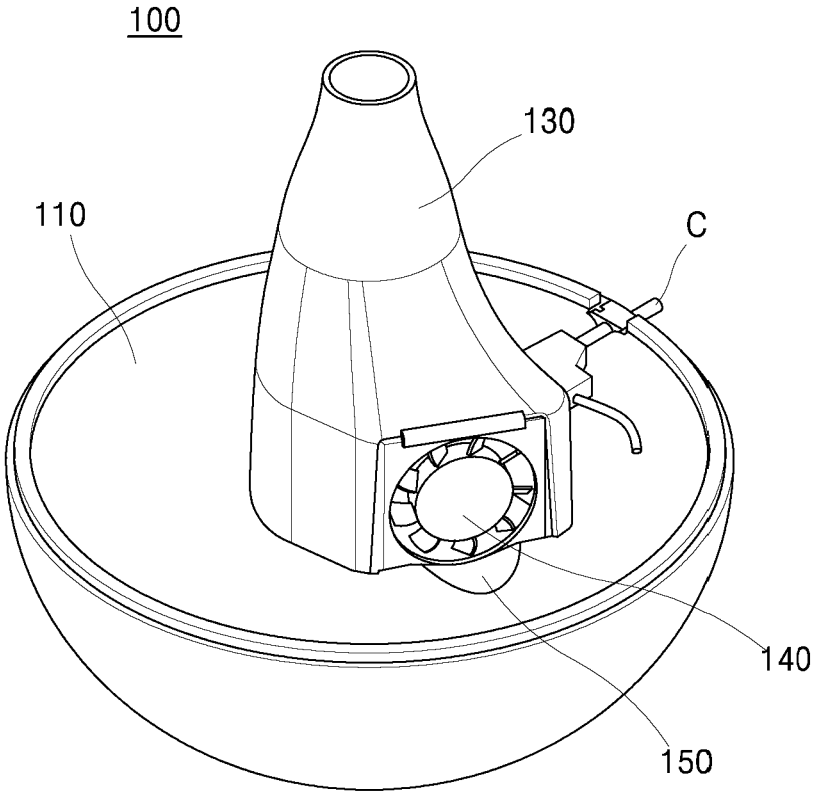
FIG. 1 is a perspective view of a floating-type humidifier according to an exemplary embodiment of the present invention.
Figure 2:
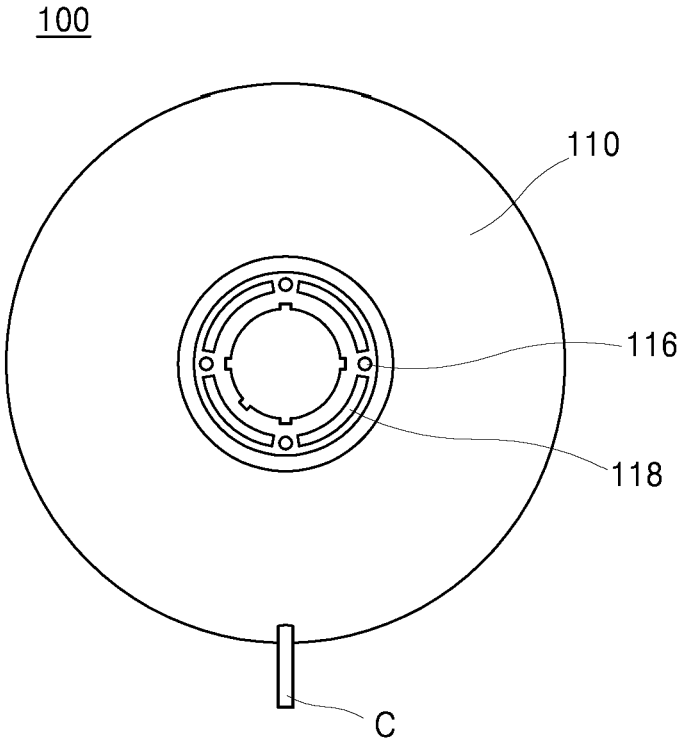
FIG. 2 is a bottom plan view of the floating-type humidifier according to the exemplary embodiment of the present invention.
Figure 3:
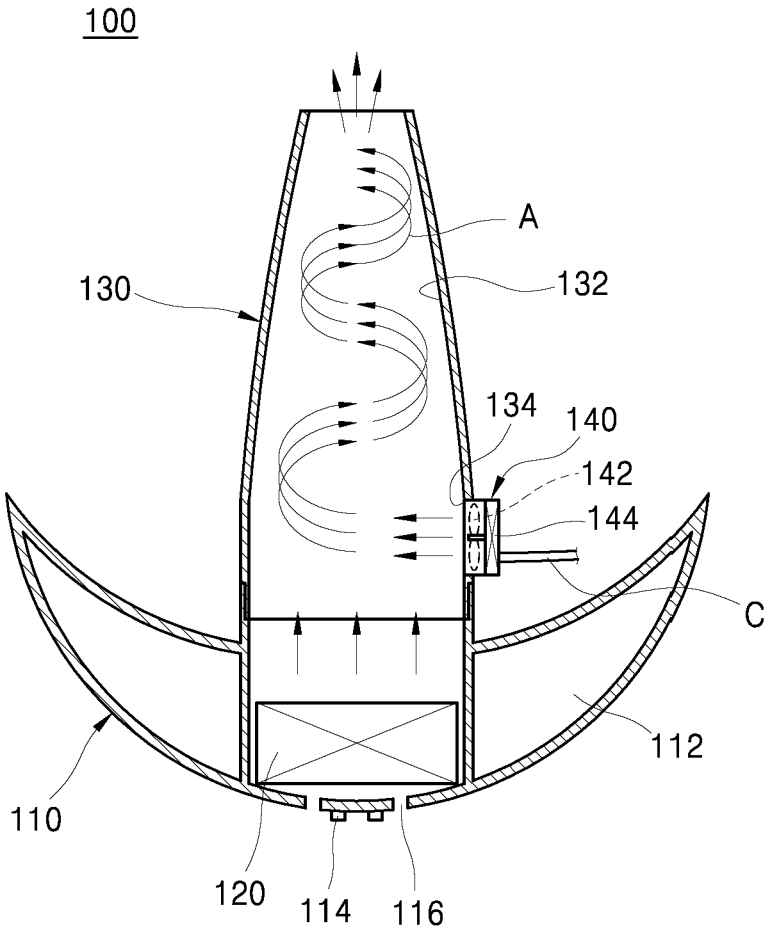
FIG. 3 is a cross-sectional front view of the floating-type humidifier according to the exemplary embodiment of the present invention.
Figure 4:
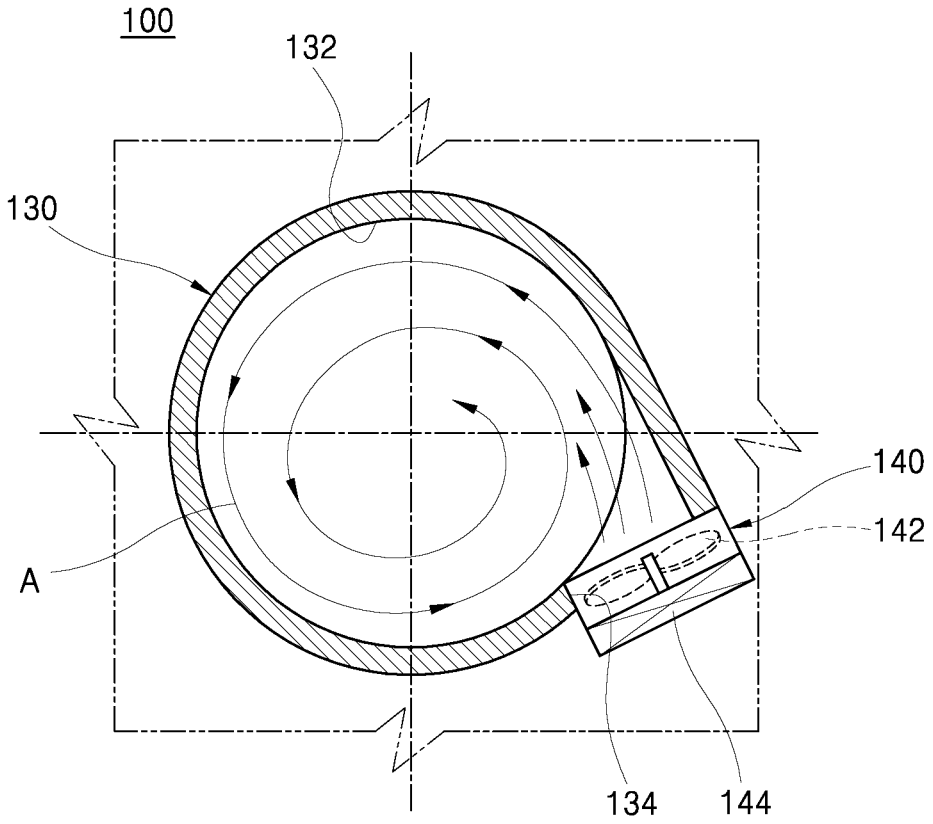
FIG. 4 is a cross-sectional plan view illustrating a state in which a blower fan of the floating-type humidifier according to the exemplary embodiment of the present invention is obliquely installed.
Figure 5:
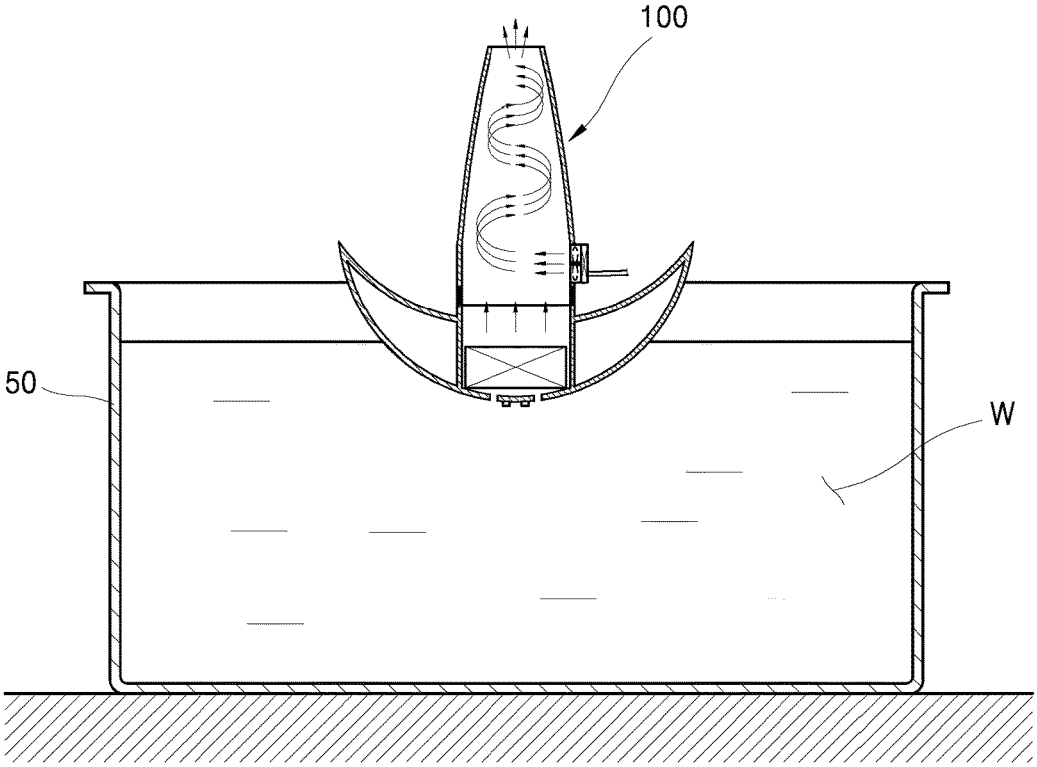
FIG. 5 is a use state view illustrating a state in which the floating-type humidifier according to the exemplary embodiment of the present invention is installed in a reservoir.

FIG. 1 is a perspective view of a floating-type humidifier according to an exemplary embodiment of the present invention, FIG. 2 is a bottom plan view of the floating-type humidifier according to the exemplary embodiment of the present invention, and FIG. 3 is a cross-sectional front view of the floating-type humidifier according to the exemplary embodiment of the present invention. Further, FIG. 4 is a cross-sectional plan view illustrating a state in which a blower fan of the floating-type humidifier according to the exemplary embodiment of the present invention is obliquely installed, and FIG. 5 is a use state view illustrating a state in which the floating-type humidifier according to the exemplary embodiment of the present invention is installed in a reservoir.

Referring to FIGS. 1 to 5, a floating-type humidifier 100 according to the exemplary embodiment of the present invention includes a floating body 110, an ultrasonic wave generation unit 120, a guide tube 130, a blower fan 140, and a discharge groove 150.

The floating body 110 floats in a reservoir 510 which accommodates water W. To this end, an upper surface of the floating body 110 is formed to be inclined downward from an edge to a central portion, and a buoyancy space 112 for generating buoyancy may be formed in the floating body 110.

For example, the floating body 110 may be formed in a bowl shape having the buoyancy space 112 formed in the floating body 110 in order to generate buoyancy so that the floating body 110 may float on the water W stored in the reservoir 510.

Therefore, the water, which is introduced into the upper surface of the floating body 110, may be easily collected to the central portion of the floating body 110 by the shape of the upper surface of the floating body 110.

A plurality of protrusions 114 may be formed on a bottom surface of the floating body 110 at a predetermined interval, and a plurality of water inlet holes 116 may be formed at a predetermined interval between the plurality of protrusions 114.

Here, the protrusions 114 allow the floating body 110 to stand vertically when there is no water W in the reservoir 510, and the protrusions 114 form a gap between a bottom surface of the reservoir 510 and the bottom surface of the floating body 110 so that water or air may be introduced or discharged through the gap.

Further, water or air, which is introduced or discharged through the gap formed by the protrusions 114, may pass through the water inlet holes 116.

The ultrasonic wave generation unit 120 is installed by being inserted into the floating body 110, and atomizes the water, which is introduced into a lower side of the floating body 110, into a water particle state by means of ultrasonic vibration. That is, the ultrasonic wave generation unit 120 may atomize the water introduced through the plurality of water inlet holes 116 formed in the bottom surface of the floating body 110.

Here, a separate power cable C may be connected to the ultrasonic wave generation unit 120, and the power cable C may extend to the outside through the floating body 110.

Further, the ultrasonic wave generation unit 120 may discharge water particles in a direction of a vertical central axis of the guide hole 132.

That is, the ultrasonic wave generation unit 120 may discharge the water particles in a direction that crosses a direction in which the blower fan 140 discharges air.

The guide tube 130 is installed vertically to extend upward from the floating body 110, and detachably coupled to the floating body 110. The guide tube 130 is positioned above the ultrasonic wave generation unit 120.

Further, a fan installation hole 134 is penetratively formed horizontally in a lateral portion of the guide tube 130 so that the blower fan 140 may be installed in the fan installation hole 134.

The guide tube 130 is installed above the ultrasonic wave generation unit 120, and serves to guide the water particles.

In this case, the guide tube 130 may guide the water particles such that the water particles flow upward along an inner guide hole 132 which defines a circle in the horizontal direction.

Here, the guide hole 132 has a shape of which the diameter is gradually decreased upward, and a discharge port is penetratively formed at an upper end of the guide tube 130 toward the outside.

Since the diameter of the guide hole 132 is decreased upward as described above, a rotational speed may be increased when air A, which is blown from the blower fan 140 and rotated spirally, passes through a portion where the diameter is small.

Therefore, a larger rotational vortex flow is generated at a discharge portion of the guide hole 132, and as a result, it is possible to expect an effect of increasing a humidification distance.

In addition, although not illustrated in the drawings, a guide groove or a guide protrusion, which is spirally formed in an up and down direction, may be formed on an inner circumferential surface of the guide hole 132.

The blower fan 140 is coupled horizontally in the fan installation hole 134, and injects air into the guide tube 130, thereby discharging the water particles to the upper side of the guide tube 130.

In this case, the blower fan 140 injects air toward the inner circumferential surface of the guide hole 132, thereby allowing the water particles to be discharged upward by the rotational vortex flow of the air.

To this end, the blower fan 140 may include rotary blades 142 and a drive motor 144, and the power cable C may be connected to the drive motor 144.

The blower fan 140 is disposed such that a center of a discharge port through which the air is injected crosses the vertical central axis of the guide hole 132, thereby obliquely injecting the air toward a wall surface at one side of the guide hole 132.

The air, which obliquely collides with the inner circumferential surface of the guide hole 132, rotates in one direction along the inner circumferential surface of the guide hole 132. In this case, a larger amount of air may be discharged by the generation of the rotational vortex flow of the air, and thus the water particles may be prevented by the air from being converted into water droplets, and as a result, it is possible to obtain a larger humidification amount.

In addition, the blower fan 140 may inject air obliquely upward toward the wall surface of the guide hole 132.

In this case, the blower fan 140 has directionality in the directions in which the air and the water particles are discharged, thereby more improving discharge velocities of the air and the water particles.

As described above, in the exemplary embodiment of the present invention, the blower fan 140 injects air so as to have directionality, thereby allowing the water particles to be discharged to the outside by the rotational vortex flow of the air.

According to the exemplary embodiment of the present invention, a large amount of air and a large number of water particles may be discharged, and the water particles and the air do not directly face each other such that the water particles may be prevented from being converted into water droplets, and as a result, it is possible to increase a humidification amount.

In addition, according to the exemplary embodiment of the present invention, since a blowing direction of the blower fan 140 is directed toward the inner circumferential surface of the guide hole 132, no impact occurs during a process of blowing air, and as a result, it is possible to minimize the occurrence of noise.

The discharge groove 150 is formed in the upper surface of the floating body 110 so as to be able to communicate with the fan installation hole 134 in which the blower fan 140 is mounted.

The discharge groove 150 is formed to be inclined downward toward the central portion along the upper surface of the floating body 110, and may discharge water, which reversely flows into the upper surface of the floating body 110, back to the water inlet holes 116 formed in the bottom surface of the floating body 110.

While the specific exemplary embodiments related with the floating-type humidifier according to the present invention have been described above, the exemplary embodiments may be modified to various exemplary embodiments without departing from the scope of the present invention.

Therefore, the scope of the present invention should not be limited to the described exemplary embodiment, but should be defined by the appended claims and the equivalents of the claims.

Accordingly, it should be understood that the aforementioned exemplary embodiment is described for illustration in all aspects and is not limited, and the scope of the present invention shall be represented by the claims to be described below, instead of the detailed description, and it should be construed that all of the changes or modified forms induced from the meaning and the scope of the claims, and an equivalent concept thereto are included in the scope of the present invention.

The invention claimed is:

1. A floating-type humidifier comprising:

a floating body which floats in a reservoir that accommodates water;

an ultrasonic wave generation unit which is installed by being inserted into the floating body, and atomizes the water, which is introduced into a lower side of the floating body, into a water particles state by means of ultrasonic vibration;

a guide tube which is detachably coupled to the floating body, is installed above the ultrasonic wave generation unit, guides the water particles, and has a fan installation hole horizontally and penetratively formed in a lateral portion of the guide tube; and a blower fan which is coupled in the fan installation hole, and injects air into the guide tube so as to discharge the water particles to an upper side of the guide tube, wherein a plurality of protrusions is formed on a bottom surface of the floating body at a predetermined interval.

2. The floating-type humidifier of claim 1, comprising:

a discharge groove which is formed in an upper surface of the floating body so as to communicate with the fan installation hole in which the blower fan is mounted.

3. The floating-type humidifier of claim 2, wherein the upper surface of the floating body is formed to be inclined downward from an edge to a central portion, and the discharge groove is formed to be inclined downward toward the central portion along the upper surface of the floating body so as to discharge water which reversely flows into the upper surface of the floating body.

4. The floating-type humidifier of claim 1, wherein a plurality of water inlet holes, which is provided at a predetermined interval between the plurality of protrusions, is formed in the bottom surface of the floating body.

5. The floating-type humidifier of claim 2, wherein the guide tube guides the water particles such that the water particles flow upward along an inner guide hole that defines a circle in a horizontal direction, and the blower fan injects air toward an inner circumferential surface of the guide hole so as to allow the water particles to be discharged upward by a rotational vortex flow of the air.

6. The floating-type humidifier of claim 5, wherein the blower fan is disposed such that a center thereof crosses a vertical central axis of the guide hole, and obliquely injects air toward a wall surface at one side of the guide hole.

7. The floating-type humidifier of claim 6, wherein the blower fan injects air obliquely upward toward the wall surface of the guide hole.

8. The floating-type humidifier of claim 5, wherein a guide groove or a guide protrusion, which is spirally formed in an up and down direction, is formed on the inner circumferential surface of the guide hole.

9. The floating-type humidifier of claim 5, wherein a diameter of the guide hole is gradually decreased upward.

10. The floating-type humidifier of claim 2, wherein the ultrasonic wave generation unit discharges water particles in a direction that crosses a direction in which the blower fan discharges air.

* * * * *